United States Patent [19]

Owen et al.

[11] Patent Number: 4,520,215

[45] Date of Patent: May 28, 1985

[54] CATALYTIC CONVERSION OF OLEFINIC FISCHER-TROPSCH LIGHT OIL TO HEAVIER HYDROCARBONS

[75] Inventors: Hartley Owen, Belle Mead; Samuel A. Tabak, Wenonah; Bernard S. Wright, East Windsor, all of N.J.

[73] Assignee: Mobil Oil Corporation, New York, N.Y.

[21] Appl. No.: 600,642

[22] Filed: Apr. 16, 1984

[51] Int. Cl.[3] ..... C07C 2/74

[52] U.S. Cl. ..... 585/255; 585/254; 585/533; 208/15

[58] Field of Search ..... 585/254, 255, 533; 208/15

[56] References Cited

U.S. PATENT DOCUMENTS

| | | | |
|---|---|---|---|
| 4,111,792 | 9/1978 | Caesar et al. | 585/251 |
| 4,213,847 | 7/1980 | Chen et al. | 208/111 |
| 4,260,841 | 4/1981 | Holland et al. | 585/319 |
| 4,433,185 | 2/1984 | Tabak | 585/312 |
| 4,444,988 | 4/1984 | Capsuto et al. | 585/415 |
| 4,456,779 | 6/1984 | Owen et al. | 585/415 |

OTHER PUBLICATIONS

M. E. Dry, "High Yield High Quality Diesel from Fischer-Tropsch Process", *Chem. SA*, v. 10(2), pp. 286-287, 290, 1984.

*Primary Examiner*—Curtis R. Davis

*Attorney, Agent, or Firm*—A. J. McKillop; M. G. Gilman; L. G. Wise

[57] ABSTRACT

A process for converting synthol light oil product of Fischer-Tropsch synthesis to heavy distillate comprising the steps of contacting the light oil at elevated temperature and pressure with acid zeolite conversion catalyst to oligomerize olefins and convert oxygenated hydrocarbons contained in the light oil thereby providing an effluent containing light heavy distillate range hydrocarbon, hydrocarbon vapor and byproduct water;

flashing and separating the effluent to recover a heavy distillate-rich liquid phase and a light hydrocarbon-rich vapor phase containing byproduct water;

condensing the vapor phase to provide a liquid hydrocarbon recycle stream;

removing byproduct water from the recycle stream;

combining the light oil with the pressurized recycle stream as heat sink to prevent excessive reaction temperature during catalytic conversion.

9 Claims, 2 Drawing Figures

CATALYTIC CONVERSION OF OLEFINIC FISCHER-TROPSCH LIGHT OIL TO HEAVIER HYDROCARBONS

FIELD OF INVENTION

This invention relates to a continuous technique for the manufacture of distillate range hydrocarbon fuels. In particular it provides a system for operating an MOGD type plant wherein a oligomerization catalyst, such as crystalline zeolite of the ZSM-5 type, is employed for converting olefinic feedstocks containing $C_5$–$C_6$ alkenes at elevated temperature and pressure.

BACKGROUND OF THE INVENTION

Conversion of olefins to gasoline and/or distillate products is disclosed, for example, in U.S. Pat. Nos. 3,960,978 and 4,021,502 (Givens, Plank and Rosinski) wherein gaseous olefins in the range of ethylene to pentene, either alone or in admixture with paraffins are converted into an olefinic gasoline blending stock by contacting the olefins with a catalyst bed made up of a ZSM-5 type zeolite. In U.S. Pat. No. 4,227,992 Garwood and Lee disclose the operating conditions for the Mobil Olefin to Gasoline/Distillate (MOGD) process for selective conversion of $C_3$+ olefins to mainly aliphatic hydrocarbons. In a related manner, U.S. Pat. Nos. 4,150,062 and 4,211,640 (Garwood et al) discloses a process for converting olefins to gasoline components. Typically, the process recycles gas or liquid hydrocarbons from a high-temperature, high-pressure separator downstream of the catalyst bed back into the reaction zone where additional olefins are converted to gasoline and distillate products. If the reaction of the olefins in converting them to distillate and gasoline is allowed to progress in the catalyst stream without any measures taken to prevent the accumulation of heat, the reaction becomes so exothermically accelerated as to result in high temperatures and the production of undesired products.

In the process for catalytic conversion of olefins to heavier hydrocarbons by catalytic oligomerization using a medium pore shape selective acid crystalline zeolite, such as ZSM-5 type catalyst, process conditions can be varied to favor the formation of either gasoline or distillate range products. At moderate temperature and relatively high pressure, the conversion conditions favor aliphatic distillate range product having a normal boiling point of at least 165° C. (330° F.). Lower olefinic feedstocks containing $C_2$–$C_8$ alkenes may be converted; however, the distillate mode conditions do not convert a major fraction of ethylene. One source of olefinic feedstocks of interest for conversion to heavier fuel products is the intermediate olefin-rich light oil obtained from Fischer-Tropch conversion of synthesis gas.

It is a main object of this invention to provide a continuous processes devised for upgrading synthol light oil intermediate by olefins to a valuable heavy distillate fuel product. A typical feedstock consists essentially of $C_5$–$C_6$ mono-olefins with a minor amount of coproduced oxygenate from Fischer-Tropsch synthesis.

SUMMARY OF THE INVENTION

A continuous process has been found for converting a feedstock mixture comprising a major amount of $C_5$–$C_6$ olefins and a minor amount of oxygenated hydrocarbons to higher hydrocarbons comprising distillate product. This process includes the steps of combining the olefinic feedstock with a pressurized liquid diluent stream comprising a major fraction of $C_5$+ olefins; contacting the diluted feedstock with a shape selective medium pore oligomerization catalyst under reaction conditions at elevated temperatures in a pressurized reactor zone to convert olefins to heavier hydrocarbons; reducing pressure on effluent from the reactor zone to flash volatile components into a vapor phase and recover a heavy liquid stream from a phase separator; condensing a major portion of the vapor phase by cooling under pressure to provide substantially all of a liquid olefinic recycle stream for combining with the feedstock and recovering condensed water by-product from oxygenate conversion to hydrocarbons; and fractionating the heavy liquid stream from the flashed reactor effluent to recover a heavy distillate hydrocarbon product stream. This technique is particularly efficient in that the recycle stream requires only a single stage separation step and may be used as a reaction heat sink directly without refined fractionation.

The recycle contains olefinic gasoline boiling range components which are further converted into distillate product. In conjunction with reactor operating conditions, the recycle composition and rate determine the distillate product boiling range and properties such as viscosity. Typically, the reactor effluent pressure is reduced from at least about 4000 kPa reactor pressure to not greater than about 1500 kPa in the phase separator. In a preferred embodiment a water-washed synthol light oil feedstock is combined with the olefinic recycle stream in a ratio of at least about 2 moles of recycle per mole feedstock olefin.

These and other objects and features of the invention will be understood from the following detailed description and drawings.

THE DRAWINGS

FIG. 1 is a process flow sheet showing the major unit operations and process streams; and FIG. 2 is a schematic representation of a fixed bed reactor system and product separation system.

DESCRIPTION OF THE PREFERRED EMBODIMENTS

The oligomerization catalysts preferred for use herein include the crystalline aluminosilicate zeolites having a silica to alumina ratio of at least 12, a constraint index of about 1 to 12 and acid cracking activity of about 160-200. Representative of the ZSM-5 type zeolites are ZSM-5, ZSM-11, ZSM-12, ZSM-23, ZSM-35 and ZSM-38. ZSM-5 is disclosed and claimed in U.S. Pat. No. 3,702,886 and U.S. Pat. No. Re. 29,948; ZSM-11 is disclosed and claimed in U.S. Pat. No. 3,709,979. Also, see U.S. Pat. No. 3,832,449 for ZSM-12; U.S. Pat. No. 4,076,842 for ZSM-23; U.S. Pat. No. 4,016,245 for ZSM-35 and U.S. Pat. No. 4,046,839 for ZSM-38. The disclosures of these patents are incorporated herein by reference. A suitable shape selective medium pore catalyst for fixed bed is HZSM-5 zeolite with alumina binder in the form of cylindrical extrudates of about 1–5 mm. Other pentasil catalysts which may be used in one or more reactor stages include a variety of medium pore (~5 to 9Å) siliceous materials such as borosilicates, ferrosilicates, and/or aluminosilicates disclosed in U.S. Pat. Nos. 4,414,423, 4,417,086, 4,417,087 and 4,417,088, incorporated herein by reference.

Figure 1:
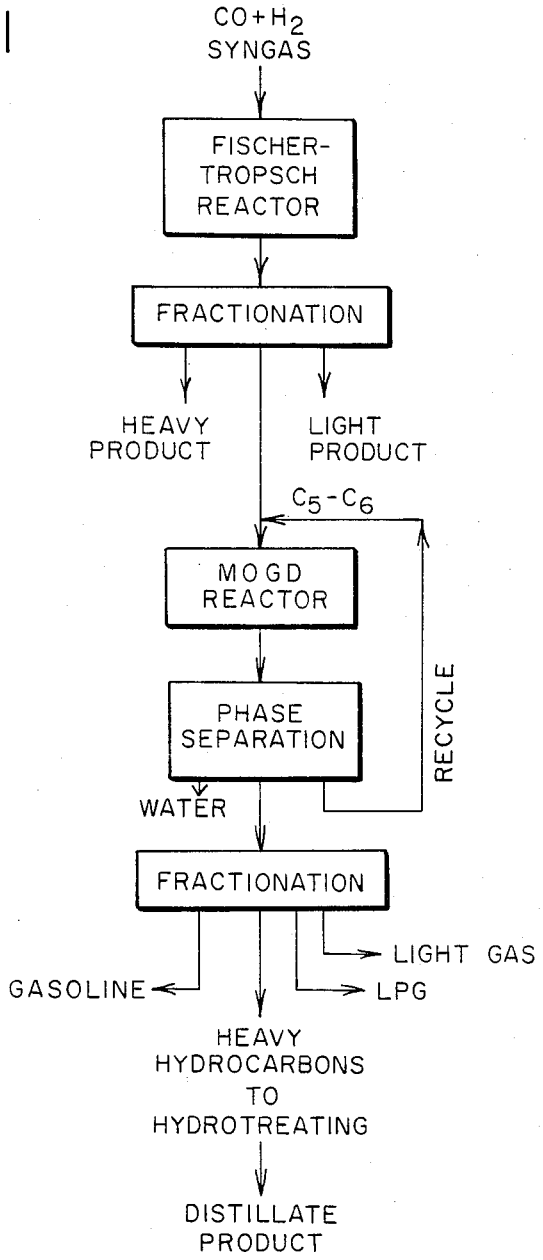

The flowsheet diagram of FIG. 1 shows the relationship of the inventive process to the preceding syngas conversion and prefractionation unit operations, depicting the further conversion of the $C_5$–$C_6$ rich olefinic intermediate, phase separation and recycle. Heavy hydrocarbons are recovered by fractionation and sent to a conventional hydrotreating unit for product finishing.

Figure 2:
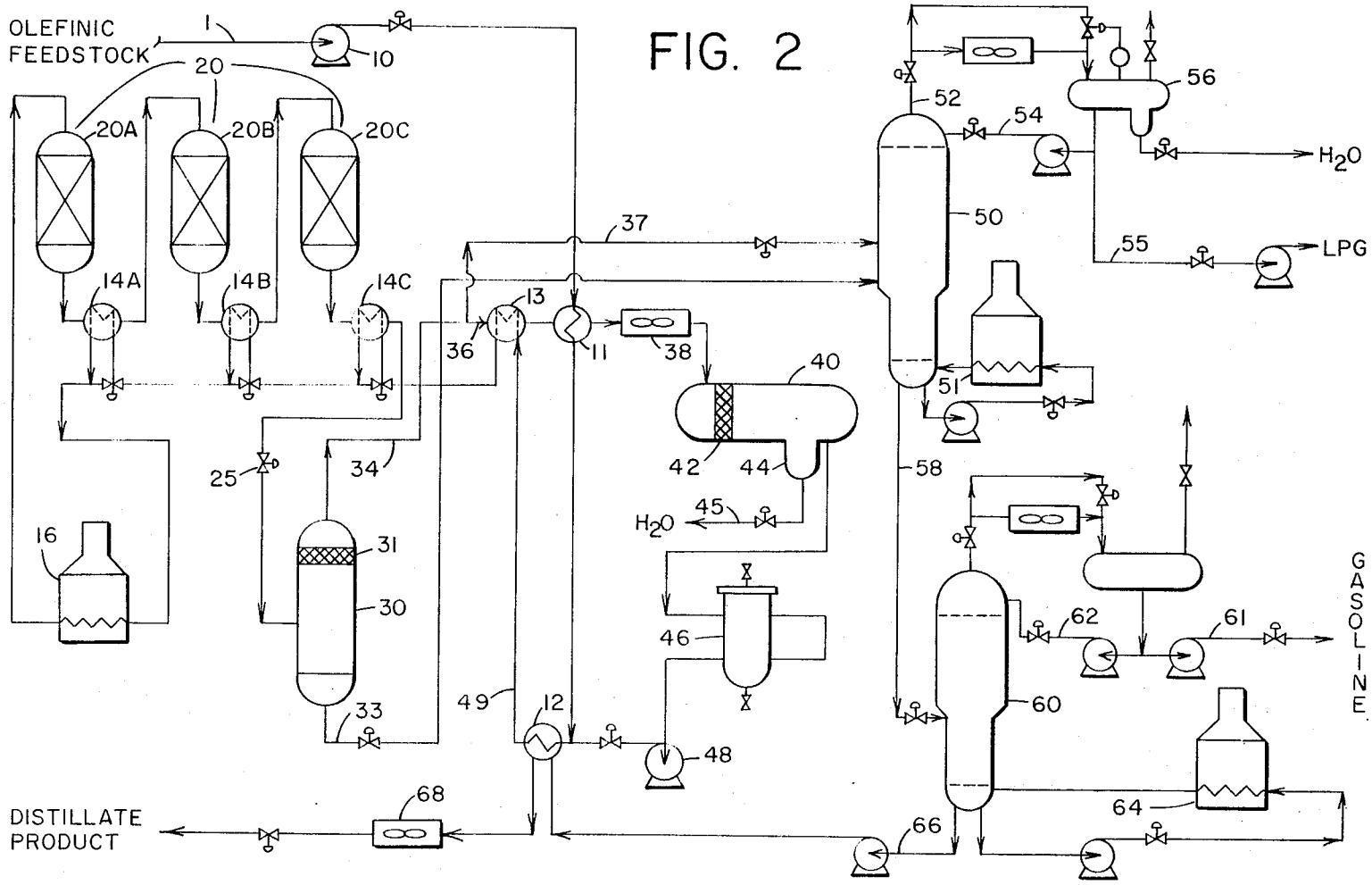

The present invention provides a continuous economic process for converting lower olefins to heavier hydrocarbons. It is an object of the present invention to separate olefinic gasoline from reactor effluent in an efficient manner to provide a recycle stream rich in $C_5$ to $C_9$ hydrocarbons and having only minor amounts of $C_4^-$ compounds or distillate range product. The gasoline recycle stream is obtained by a phase separation technique wherein the reactor effluent stream is cooled to condense heavy hydrocarbons, especially distillate materials, which are recovered in a liquid stream. These aspects are shown in greater detail in FIG. 2 and in the following description.

GENERAL PROCESS DESCRIPTION

The olefinic feedstock supply 1 is normally liquid and can be brought to process pressure by means of pump 10 and preheated by passing sequentially through a series of heat exchange means 11, 12, 13 and reactant effluent exchangers 14C, B, A, and furnace 16 prior to entering the catalytic reactor system 20.

A typical distillate mode first stage reactor system 20 is shown. A multi-reactor system is employed with inter-zone cooling, whereby the reaction exotherm can be carefully controlled to prevent excessive temperature above the normal moderate range of about 230° to 325° (450°–620° F.). While process pressure may be maintained over a wide range, usually from about 2800 to over 10,000 kPa (400–1500 psia), the preferred pressure is about 4000 to 7000 kPa (600 to 1000 psia). The feedstock is heated to reaction temperature and carried sequentially through a series of zeolite beds 20A, B, C wherein at least a portion of the olefin content is converted to heavier distillate constituents. Advantageously, the maximum temperature differential across only one reactor is about 30° C. ($\Delta T \sim 50°$ F.) and the space velocity (LHSV based on olefin feed) is about 0.5 to 1.5. The heat exchangers 14A and 14B provide inter-reactor cooling and 14C reduces the effluent to flashing temperature. Control valve 25, operatively connected between the reactor section 20 and phase separator unit 30 provides means for reducing the process pressure, thereby vaporizing volatile components of the effluent stream, such as unreacted lighter hydrocarbons (e.g. $C_5$–$C_6$ alkenes) and water. The separator may be a vertical cylindrical vessel having a hooded tangential inlet to effect separation of the flashed effluent mixture. A demister pad 31 prevents substantial liquid entrainment and a major amount of the overhead vapor is withdrawn through conduits 34, 36, cooled indirectly by incoming feedstock in exchangers 13, 11 and passed through air cooler 38 to condense the lighter hydrocarbons in the separator vapor phase along with byproduct water from oxygenate conversion. Surge tank 40 includes a coalesser zone 42 to separate water, which is withdrawn from the system through boot 44 and outlet 45. Condensed vapor provides essentially all of the liqid olefinic recycle stream and is passed from the surge tank 40 through filter means 46 and pressurizing by pump means 48 prior to combining with feedstock in conduit 49.

Liquid hydrocarbons rich in distillate are recovered from phase separator 30 at flashing pressure, preferrably about 1100 to 1500 kPa (160 to 220 psia) and passed via conduit 33 to debutanizer fractionation tower 50 at a lower stage therein where the heavy liquid contacts rising vapor from reboiler section 51 to vaporize dissolved lighter hydrocarbons, especially $C_4^-$ hydrocarbons present in the feedstock or generated during conversion. The debutanizer overhead stream 52 may be cooled to produce reflux 54 and recovered as LPG byproduct through conduit 55 from accumulator 56.

The amount of recycle can be varied according to need. During steady state operation at design conditions, a minor amount (e.g. 7–8%) of separator overhead vapor from line 34 is taken as a slipstream through conduit 37 and sent directly to the debutanizer tower 50 at an intermediate stage. Light hydrocarbons and byproduct water are withdrawn with the tower overhead stream 52 and heavier hydrocarbons containing gasoline on distillate range hydrocarbons are sent along with the debutanizer bottoms stream 58 to product splitter 60 where the heavier hydrocarbons are fractionated to provide a condensed gasoline product 61 and condensed reflux 62. Splitter tower 60 has a furnace fired reboiler section 64 and the refined heavy distillate product is recovered through conduit 66, and cooled by incoming feedstock in exchanger 12 and in cooler 68. Advantageously, the distillate-rich liquid phase is fractionated to provide a major product stream consisting essentially of 154° C.+ aliphatic hydrocarbons comprising a major amount of $C_{10}$–$C_{20}$ aliphatic hydrocarbons. This product may then be hydrotreated in a separate process step (not shown) to provide a heavy distillate product having a viscosity of at least about 1.8 centistokes. Details of a mild hydrogenation treatment may be obtained from U.S. Pat. No. 4,211,640, incorporated by reference, typically using Co or Ni with W/Mo and/or noble metals.

In order to obtain heavy distillate product having a relatively high viscosity, higher reaction pressures are employed. For instance, if a 3 centistoke fuel product is required, a process pressure of at least 5500 kPa (800 psia) is suggested.

There are several advantages to the process design. The heavier recycle consists essentially of $C_5$+ hydrocarbons, with minor amounts of $C_4^-$ components. This recycle material has a relatively high heat capacity and provides a good heat sink without diminishing feedstock olefin partial pressure and thereby maintaining a high olefin partial pressure at reactor inlet. The liquid recycle is economically repressurized by pumping, which requires modest power consumption. The debutanizer is operable at about 1000 kPa (150 psi) to condense all overhead without refrigeration, thus providing energy efficiency in obtaining the LPG byproduct. The product splitter tower can be operated at atmospheric pressure, thus holding the bottoms temperature to less than 273° C. (525° F.) to provide raw distillate product stability.

A typical distillate mode oligomerization operation is conducted over a fixed bed of HZSM-5/alumina extrudate catalyst using the techniques described in U.S. patent applications Ser. No. 488,834, filed Apr. 26, 1983 (Owen et al), now U.S. Pat. No. 4,456,779, and Ser. No. 481,705, filed Apr. 4, 1983 (Tabak) U.S. Pat. No. 4,433,185, incorporated herein by reference. Reactor sequencing and catalyst regeneration are known in the art.

Feedstock is derived from synthesis gas conversion product made according to a commercial Fischer-Tropsch process (SASOL), disclosed in U.S. Pat. No. 4,111,792. Typically, such materials have an oxygenated hydrocarbon content of about 0.5 to 10 wt percent. A $C_5$–$C_6$ (75 mole percent) olefin fractionation cut containing coproduced alcohol, ethers, aldehyde, and/or ketone oxygenates is water washed to remove excess oxygenates and reduce their amount to less than 5 wt percent. The oligomerization feedstock properties for a preferred embodiment are set forth in Table I and liquid product properties are in Table II.

TABLE I

FEED PROPERTIES

| Hydrocarbon Component | Mol. % |
|---|---|
| Propene | 0.06 |
| Butenes | 8.45 |
| Butanes | 1.55 |
| Pentenes | 37.36 |
| Pentanes | 6.32 |
| Hexenes | 37.72 |
| Hexanes | 2.49 |
| $C_7$ Olefins | 4.00 |
| $C_7$ Paraffins | 1.68 |
| Aromatics | 0.37 |
| Gravity, °API | 82.89 |
| Molecular Weight (Average) | 76.29 |
| Dienes, | Undetectable |
| Sulfur | Undetectable |
| Nitrogen | Undetectable |
| Water content, Wt % | 0.006 |
| Oxygenates, Wt % | 3.43 |

TABLE II

TYPICAL PRODUCT PROPERTIES

| Properties | $C_6$-154° C. Gasoline* | 154+° C. Distillate Raw | 154+° C. Distillate Hydrotreated |
|---|---|---|---|
| Gravity, °API | 72 | ~48 | ~50 |
| Total Sulfur, | Undetectable | Undetectable | |
| Octane Number (R + O) | 79 | — | — |
| Bromine Number | — | 80 | <2 |
| Pour Point, °C. | — | <−54 | <−54 |
| Cloud Point, °C. | — | <−54 | <−54 |
| Cetane Number (engine) | — | ~35 | >50 |
| Cetane Index | — | ~63 | ~68 |
| Viscosity (centistokes) | — | — | 2.3–3 |

*60 Wt % Olefins, 2 Wt % Aromatics

Various modifications can be made to the system, especially in the choice of equipment and non-critical processing steps. While the invention has been described by specific examples, there is no intent to limit the inventive concept as set forth in the following claims.

What is claimed is:

1. A continuous process for converting a feedstock mixture comprising a major amount of $C_5$–$C_6$ olefins and a minor amount of oxygenated hydrocarbons to higher hydrocarbons comprising distillate product comprising:

combining olefinic feedstock with a pressurized liquid recycle stream comprising a major fraction of $C_5$+ olefins;

contacting the diluted feedstock with a shape selective medium pore oligomerization catalyst under reaction conditions at elevated temperature in a pressurized reactor zone to convert olefins to heavier hydrocarbons;

reducing pressure on effluent from the reactor zone to flash volatile components into a vapor phase and recover a heavy liquid stream from a phase separator;

condensing a major portion of the vapor phase by cooling under pressure to provide substantially all of a liquid olefinic recycle stream for combining with the feedstock, and recovering condensed water by-product from oxygenate conversion to hydrocarbons; and fractionating the heavy liquid stream from the flashed reactor effluent to recover a heavy distillate hydrocarbon product stream.

2. The process of claim 1 comprising the further step of hydrotreating the distillate hydrocarbon product stream to obtain a distillate product having a viscosity of at least 1.8 centistokes, cetane number greater than 50, and bromine number less than 2.

3. The process of claim 2 wherein the hydrotreated distillate product has a viscosity of about 3 centistokes, API gravity of about 50, and a pour point and cloud point less than −54° C.

4. The process of claim 1 wherein reactor effluent pressure is reduced from at least about 4000 kPa reactor pressure to not greater than about 1500 kPa in the phase separator.

5. The process of claim 2 wherein the feedstock is combined with the olefinic recycle stream in a ratio of at least about 2 moles of recycle per mole of feedstock olefin and contacted with a fixed bed of acid aluminosilicate zeolite catalyst having a constraint index of about 1 to 12 at a reaction temperature of about 230° C. to 325° C. at process pressure of about 4000 to 7000 kPa to convert a major amount of feedstock olefins.

6. A process for converting synthol light oil product of Fischer-Tropsch synthesis to heavy distillate comprising the steps of contacting said light oil at elevated temperature and pressure with acid zeolite conversion catalyst to oligomerize olefins and convert oxygenated hydrocarbons contained in said light oil thereby providing an effluent containing heavy distillate range hydrocarbon, light hydrocarbon vapor and by-product water;

flashing and separating said effluent to recover a heavy distillate-rich liquid phase and a light hydrocarbon-rich vapor phase containing byproduct water;

condensing said vapor phase to provide a liquid hydrocarbon recycle stream;

removing byproduct water from said recycle stream;

combining said light oil with the re-pressurized recycle stream as heat sink to prevent excessive reaction temperature during catalytic conversion.

7. The process of claim 6 wherein the distillate-rich liquid phase is fractionated to provide a major product stream consisting essentially of 154° C.+ aliphatic hydrocarbons comprising a major amount of $C_{10}$–$C_{20}$ aliphatic hydrocarbons.

8. The process of claim 7 further comprising the step of hydrotreating said distillate product stream to provide a heavy distillate product having a viscosity of at least about 1.8 centistokes.

9. The process of claim 6 wherein the catalyst comprises a ZSM-5 type zeolite.

* * * * *